United States Patent [19]

Hopkins et al.

[11] 4,256,188

[45] Mar. 17, 1981

[54] METHOD AND APPARATUS FOR DRILLING A HOLE IN A BODY OF ICE AND FOR THE DESTRUCTION OF A BODY OF ICE

[75] Inventors: Robert M. Hopkins; Roger C. Parsons, both of St. John's, Canada

[73] Assignee: Resource Development Consultants Ltd., St. John's, Canada

[21] Appl. No.: 924,988

[22] Filed: Jul. 17, 1978

[51] Int. Cl.[3] ..... F25C 5/04

[52] U.S. Cl. ..... 175/18; 175/57; 299/3; 299/24; 405/131; 405/217; 252/70

[58] Field of Search ..... 175/18, 57; 299/3, 5, 299/24; 252/70; 134/42, 19, 37, 5; 405/131, 217; 241/1; 114/40, 42; 62/83; 37/12; 261/DIG. 20; 244/134 C

[56] References Cited

U.S. PATENT DOCUMENTS

| | | | |
|---|---|---|---|
| 629,539 | 7/1899 | Bertram | 175/18 |
| 635,522 | 10/1899 | Stuart | 175/18 |
| 1,915,018 | 6/1933 | Erhardt | 252/70 |
| 2,178,675 | 11/1939 | Thomas | 252/70 |
| 2,466,773 | 4/1949 | Kestenbaum | 299/3 |
| 2,816,735 | 12/1957 | Dalinda et al. | 175/16 X |
| 3,096,832 | 7/1963 | Westre | 175/18 |
| 3,274,785 | 9/1966 | Lange | 405/131 |
| 3,749,162 | 7/1973 | Anders | 175/7 |
| 3,776,775 | 12/1973 | Lazarus | 252/70 X |

FOREIGN PATENT DOCUMENTS

| | | | |
|---|---|---|---|
| 1111936 | 5/1968 | United Kingdom | 252/70 |

*Primary Examiner*—James A. Leppink
*Assistant Examiner*—Richard E. Favreau
*Attorney, Agent, or Firm*—Fetherstonhaugh & Co.

[57] ABSTRACT

A method and apparatus for drilling a hole in a body of ice and for destroying a body of ice. The method comprises the steps of providing a source of reactant gas of a type which will react chemically with ice to form solid compounds which are unstable and which break down rapidly to water and a dissolved gas. The reaction product which is formed is removed quickly in order to avoid a secondary and initially undesirable exothermic reaction of gas dissolution into the water so formed. The reactant gas is directed through a nozzle to generate a stream of reactant gas. The nozzle is located in close proximity to a body of ice, and the stream of reactant gas is directed against a localized area of the surface of said body of ice at a velocity and flow rate to obtain an optimum phase change reaction with the ice and to quickly remove water formed from the ice in the localized area. The nozzle is advanced towards the body of ice to continue to direct the stream of reactant gas against the receding surface of the body of ice in the localized area as the ice undergoes a phase change to the liquid state to destroy the body of ice or to form a hole in the localized area in the body of ice.

26 Claims, 6 Drawing Figures

STEP 1 IMPINGEMENT OF GAS

STEP 2 FORMATION OF $NH_3H_2O_{(s)}$

STEP 3 FORMATION OF $NH_{3(aq)} + H_2O_{(1)}$

STEP 4 PHASE CHANGES OF REACTION PRODUCTS

METHOD AND APPARATUS FOR DRILLING A HOLE IN A BODY OF ICE AND FOR THE DESTRUCTION OF A BODY OF ICE

FIELD OF INVENTION

This invention relates to a method and apparatus for destroying a body of ice and for drilling a hole in a body of ice.

PRIOR ART

Conventional methods fall into two categories, namely, mechanical methods and thermal methods.

Mechanical methods of drilling a hole in a body of ice include the use of a drill or auger which is rotatably driven into the body of ice. The apparatus required in order to drill a hole in ice is cumbersome and difficult to operate, particularly under Arctic conditions. In addition, the drilling tool must be replaced or sharpened at frequent intervals and the servicing of the drilling tool and other mechanical components is difficult under adverse weather conditions.

Thermal processes for destroying a body of ice and drilling a hole in ice operate on the basis of transferring heat to the ice to supply enough energy to convert the ice from the solid to the liquid phase and to maintain it in the liquid phase. Examples of such systems are well known and include apparatus designed to deliver steam jets or hot water jets. These systems have a high heat requirement and make a very inefficient use of the heat which is supplied. They are inherently slow because heat has to be transferred through a liquid film on the ice surface.

Dry thermal systems such as heated rods have also been used to form a hole in a body of ice. The heated rod system operates very slowly and is not considered to be practical for the vast majority of commercial applications.

A method of removing ice from the windshield of an automobile or the like is described in U.S. Pat. No. 3,776,775. The system disclosed in this patent provides a source of two dissimilar chemical compositions which react with one another to produce a high temperature fluid which is then directed against the surface of the ice to melt the ice. The two compositions are stored in two separate compartments in a dispenser container and are only mixed when dispensed therefrom. The two compositions must be carefully formulated and carefully mixed at the nozzle to obtain the required generation of heat. Thus, in this known system heat is generated as soon as the apparatus is activated to discharge the compositions therefrom. The system is, therefore, a self-sustaining thermal system which provides a source of heat capable of melting ice.

The present invention overcomes the difficulties of the prior art described above and provides a simple and efficient method for destroying a body of ice wherein the ice itself reacts chemically with a stream of gas directed against a localized area thereof. In this method the gas is of a type which will react chemically with ice to form unstable compounds which immediately revert to water and dissolved gas but will not react to generate heat until it makes contact with the ice or water.

SUMMARY OF INVENTION

According to one aspect of the present invention, there is provided a method of destroying a body of ice and for drilling a hole in a body of ice which comprises the steps of: providing a source of reactant gas of a type which will react chemically with ice to form unstable compounds which immediately revert to water and dissolved gas; directing said reactant gas through a nozzle to generate a stream of reactant gas; locating said nozzle in close proximity to a body of ice; directing said stream of gas against the surface of said body of ice at a velocity and flow rate to obtain an optimum solid to liquid phase change reaction with the ice; immediately removing the water formed from the ice and the dissolved gas and advancing the nozzle towards the body of ice to continue to direct the stream of reactant gas against the receding surface of the body of ice to destroy the ice.

According to a further aspect of the present invention, the reactant gas may be selected from the group consisting of ammonia, hydrogen chloride, sulphur dioxide or ammonium chloride above its dissociation temperature of 340°, or other gases which fall within the following classes of chemicals: ammonium salts of the Halogens, Halogen Acids, Ammonium Salts of Sulfur, Oxygen Acids, and Oxides of Sulfur. All the above reactant gases will react with ice to form an unstable compounds where the end products formed have the property that the summation of their energies, forming the Gibbs free energy, is negative.

The invention will be more clearly understood after reference to the following detailed specification read in conjunction with the drawings wherein, FIG. 1 is a diagrammatic illustration of an ice drilling device according to an embodiment of the present invention;

Figure 1:
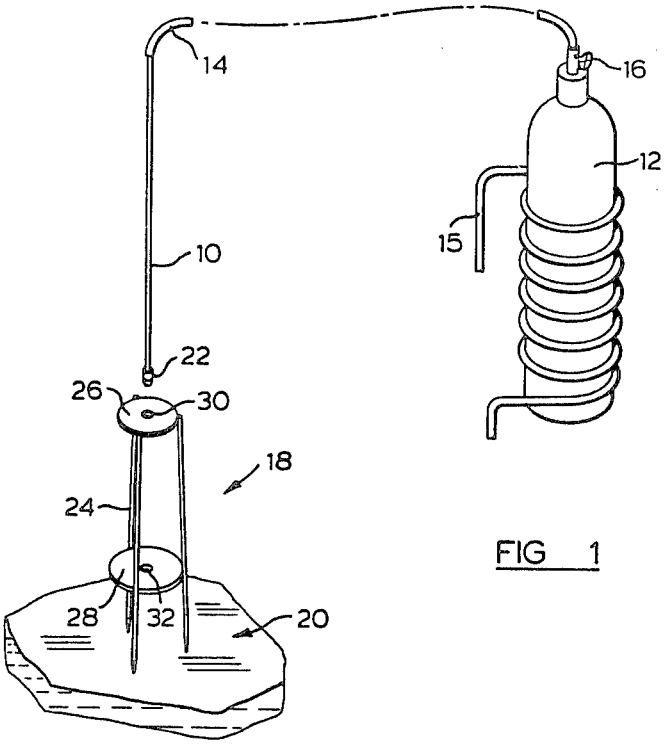

With reference to FIG. 1 of the drawings, a drill rod 10 is shown to be connected to a gas storage tank 12 by means of a flexible conduit 14. A pressure flow volume control valve 16 is provided in the line connecting the conduit 14 and container 12. A drill rod guide 18 is provided for guiding the drill rod axially towards a body of ice 20.

The drill rod 10 is in the form of a hollow tubular member and has a nozzle 22 located at one end thereof. The container 12 contains a supply of a reactant gas from the following classes of chemicals: Ammonia, Ammonium salts of the Halogens, Halogen Acids, Ammonium Salts of Sulfur, Oxygen Acids, and Oxides of Sulfur which reacts with ice to generate unstable compounds which in turn break down into a solution of the reactant gas in water. A heating element 15 is wound around the container 12 and serves to heat the container as the reactant gas is discharged therefrom to maintain the required vapor pressure and thereby the flow. Examples of suitable reactant gases are ammonia, hydrogen chloride, sulphur dioxide and ammonium chloride, above its dissociation temperature. The latter will also be a suitable reactant if heated as described below with reference to FIG. 3.

The drill rod guide 18 consists of a tripod frame 24 having upper and lower guide rings 26 and 28 having passages 30 and 32 opening therethrough for guiding the drill rod vertically into the body of ice in use.

Figure 2:
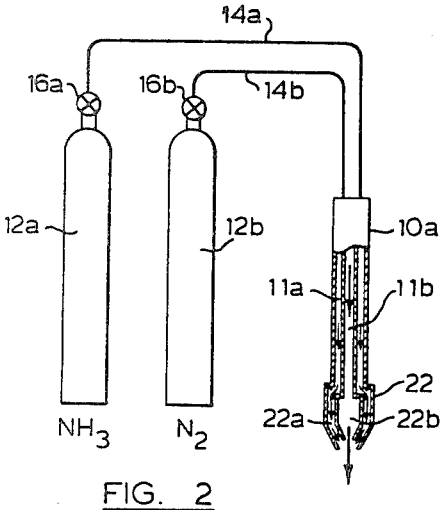
FIG. 2 is a diagrammatic representation of an ice drilling mechanism according to a further embodiment of the present invention.

FIG. 2 of the drawings illustrates a modified apparatus in which storage containers 12*a* and 12*b* are provided. The storage container 12*a* has a control valve 16*a* and the storage container 12*b* has a control valve 16*b*. Conduits 14*a* and 14*b* connect the control valves 16*a* and 16*b* to a drill rod 10*a* which has coaxial passages 11*a* and 11*b* extending therethrough. The passage 11*b* is connected to conduit 14*b* and the passage 11*a* is connected to conduit 14*a*. The nozzle 22 has a through passage 22*a* which communicates with the passage 11*a* of the drill rod and a passage 22*b* which communicates with the passage 11*b* of the drill rod. In this apparatus, the container 12*a* may contain a reactant such as ammonia and the container 12*b* may contain an inert gas such as nitrogen, the ammonia and inert gas being mixed at the discharge end of the nozzle 22. It will, however, be noted that the mixing of the two gases does not result in a chemical reaction.

Figure 3:
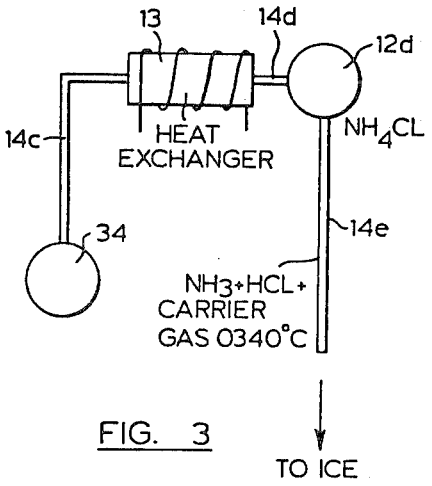
FIG. 3 is a diagrammatic view of an ice drilling mechanism according to a still further embodiment of the present invention.

FIG. 3 illustrates a further system according to an embodiment of the present invention in which an inert carrier gas from a source 34 is conveyed to a heat exchanger 13 by conduit 14*c*. The carrier gas is conveyed from the heat exchanger 13 by conduit 14*d* to a source 12*d* which may contain a reactant such as ammonium chloride ($NH_4CL$). Dissociated ammonium chloride mixed with the carrier gas is conveyed to a drill rod by way of conduit 14*e*.

In use, a stream of reactant gas impinges on a localized area of the surface of a body of ice. The reactant gas absorbs on the surface of the ice forming an unstable product which dissociates into a solution of the reactant gas in water.

The mechanism whereby ice is destroyed with soluble gases, using ammonia as an example, is considered to be as follows:

When anhydrous ammonia is impinged upon ice, two ammonia hydrates are formed, namely $NH_3.H_2O$ and $2NH_3.H_2O$. At temperatures above 194° K. (−79° C.) both of these compounds are unstable and decompose into a complex mixture of ice ($H_2O_{(s)}$), water ($H_2O_{(1)}$) dissolved ammonia ($NH_{3\,(aq)}$), gaseous ammonia ($NH_3(g)$), ammonium ions ($NH_4+$) and hydroxyl ions ($OH-$). Contrary to general belief, undissociated ammonium hydroxide ($NH_4OH$) has not been shown to exist in aqueous solution, and equilibrium data shows that $NH_4+$ and $OH-$ can exist only in very small amounts. The equilibrium constant for the reaction $$NH_{3(aq)}+H_2O_{(1)}\rightleftarrows NH_4++OH-$$

is $$K=[NH_4+][OH-]/[NH_3]=1.81\times10^{-5}$$

Hence when ammonia is impinged on ice, depending upon the temperature of the system, the main reactions governing the process are considered to be as follows:

$$NH_{3(g)}+H_2O_{(s)}\leftrightarrows NH_3.H_2O_{(s)}$$

$$2NH_{3(g)}+H_2O_{(s)}\leftrightarrows 2NH_3.H_2O_{(s)}$$

$$NH_3.H_2O_{(s)}\rightleftarrows H_2O_{(1)}+NH_{3(aq)}$$

$$2NH_3.H_2O_{(s)}\rightleftarrows H_2O_{(1)}+2NH_{3(aq)}$$

$$NH_{3(g)}+[H_2O]_{(s)}\leftrightarrows NH_{3(aq)}+[H_2O]_{(1)}$$

In essence, these reactions mean that if anhydrous ammonia is impinged on ice at a temperature above 194° K. the following sequence of events occur.

Figure 6:
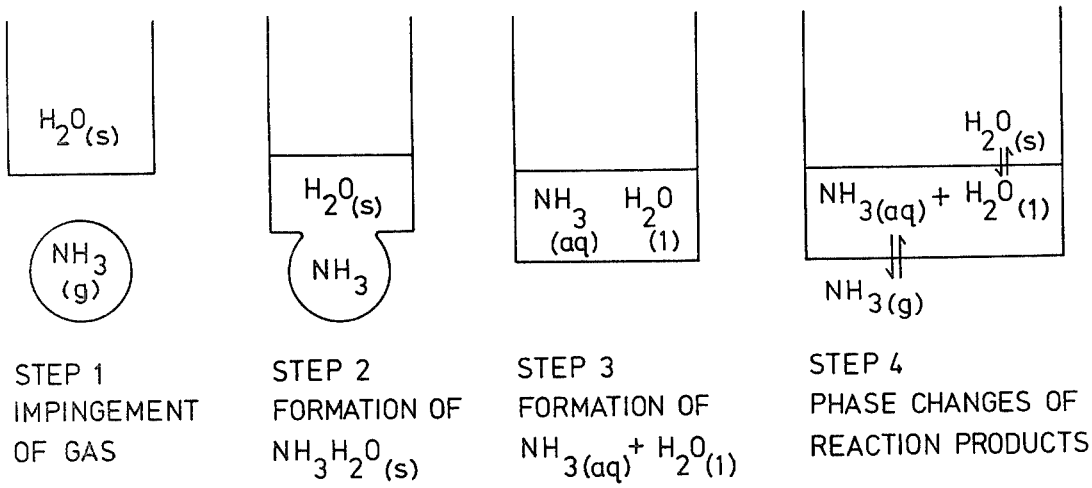
FIG. 6 is a diagram showing four steps of a method for destroying ice.

With reference to FIG. 6, it will be seen that Step 1 represents the reactant gas impinging the ice, Step 2 is the formation of $NH_3\ H_2O_{(s)}$, Step 3 is the formation of $NH_{3(aq)}$ and $H_2O_{(L)}$ and Step 4 illustrates the phase changes of the reaction products.

Step 4 represents the changes that the reaction products can undergo. These are highly temperature dependent, since ice can be reformed according to the equilibrium between ice and water.

$$H_2O_{(1)}\rightleftarrows H_2O_{(s)} \quad \text{(temp. dependent)}$$

Ammonia can re-enter the vapour phase according to the reaction $$NH_{3(aq)}\rightleftarrows NH_{3(g)} \quad \text{(temp. and pressure dependent)}$$

Depending on conditions of temperature and pressure, ammonia can enter the liquid phase and because of the heat of dilution involved result in the melting of ice by thermal heat transfer process. However, such a process is initially highly undesirable as the thermal conductivity of aqueous $NH_3$ solutions is very low $8.2676\times10^{-4}$ CAL./sec.- cm.- °C. (0.2 BTU/ft- hr- °F.) and the melting rate very slow. Consequently this reaction competes for ammonia with the main reaction of the process (the formation of unstable $NH_3.H_2O$ and $2NH_3.H_2O$) and as a result is initially undesirable in that the dilution can take place between the nozzle and the receding ice surface utilizing the water formed from the break down of the unstable compounds and the ammonia gas being supplied. It is by this method that the secondary reaction (i.e. dilution) competes for ammonia and reduces the effectiveness of the device. Once the liquid melt water resulting from the break down of unstable compounds has been quickly removed from the interface between the nozzle and receding ice surface, this secondary reaction is supplementary in that it destroys ice by thermal process as it moves away from the interface while not competing with the prime reaction (i.e. formation of unstable compounds). This maximizes penetration rate (controlled by formation of unstable compounds) and destruction rate (controlled by formation of unstable compounds and supplemented by thermal processes).

Steps are thus taken to avoid the secondary dilution reaction at the interface (between nozzle and receding ice surface). These are:

(1) using $NH_3$ gas velocities up to the speed of sound to remove the aqueous phase from the surface of the ice as quickly as possible.

(2) combining the ammonia with an inert gas such as nitrogen to serve as a vehicle for removal of the aqueous phase.

The drilling process does not cause elevated temperatures of any of the components. It is essentially an isothermal process and does not rely on the creation of a thermal gradient between a liquid and the ice surface. It relies on a phase change of the ice to the liquid phase via the formation of the unstable compound $NH_3.H_2O$ and $2NH_3.H_2O$. By this method the inefficiency inherent in current methods that of the slowness of heat transfer through a water media is avoided.

The apparatus of FIG. 1 would operate in accordance with the above system when the storage container 12 is charged with ammonia. As previously described, gases other than ammonia which fall within the following classes of chemicals: Ammonium Salts of the Halogens, Halogen Acids, Ammonium Salts of Sulfur, Oxygen Acids and Oxides of Sulfur, can be used in the drilling apparatus with associated advantages and disadvantages. For example, if $NH_4Cl$ is used, more ice can be destroyed per unit mass of gas. However, $NH_4Cl$ has to be volatized in the field, therefore requiring a higher capacity heat source. On the other hand $NH_4Cl$ produces a large freezing point depression (as do all described reactants) thereby eliminating the problem associated with refreezing.

In certain applications, it may be desirable to combine the reactant with an inert gas such as nitrogen or air and this can be achieved by means of the apparatus illustrated in FIG. 2 of the drawings.

In a system in which the reactant is ammonium chloride, for example, a heating system is required to volatize the ammonium chloride. Such a system is illustrated in FIG. 3 of the drawings wherein the carrier gas is heated in a heat exchanger before it is admitted to the ammonium chloride storage container. By this means HCl and $NH_3$ are at too high a temperature to react with each other but react directly with the ice.

Drilling tests have shown that a hole can be formed in a body of ice very efficiently by directing a stream of ammonia against a localized area of the surface of a body of ice.

EXAMPLE I

Test Procedure

The experiments on the ice penetration system were conducted using four different size nozzles, ranging from a 1.0 mm diameter nozzle to a 4.0 mm diameter nozzle. For each different size nozzle flow rates from 20 L/min through 120 L/min were tested.

Then for each nozzle size and each different flow rate, a series of holes was drilled in the ice. This procedure consisted of drilling three holes for time periods of 5, 10, 15, 20 and 25 seconds for each flow rate. This constituted a set of readings and for each set a graph of depth drilled versus time was plotted. From these graphs drilling rates were determined.

Immediately after the holes were drilled, they were filled with water at 0° C. (to prevent further melting) in order to measure the volume of ice destroyed. Then graphs of volume of ice destroyed versus time were plotted and from these ice destruction rates were obtained. This information, in conjunction with calculated thermodynamic efficiencies, supplied the necessary information to obtain the optimum operating conditions for the ice penetration system.

A series of drilling tests were carried out using ammonia. Horizontal and vertical drillings were performed using pure ammonia and results obtained for each. From these results, drilling rates were determined using the method described above. The results of these tests were as set forth below in Table 1 and Table 2.

TABLE 1

| FLOW RATE L/min (approx.) | HORIZONTAL DRILLING RATES (cm/min) 1.0 mm nozzle | 2.0 mm nozzle | 3.0 mm nozzle | 4.0 mm nozzle |
|---|---|---|---|---|
| 15 | 42 | 20.4 | 21.9 | — |
| 23 | 62.4 | 55.2 | — | — |
| 31 | 71.2 | 54.6 | 47.4 | — |
| 39 | 75 | 86.4 | — | — |
| 46 | 82.8 | 71 | variable | 40.2 |
| 62 | — | 97 | 87 | 97.2 |
| 77 | — | 144 | 87 | 118.5 |
| 92 | — | — | 99 | 141 |

TABLE 2

| FLOW RATE L/min (approx.) | VERTICAL DRILLING RATE (cm/min) 1.0 mm nozzle | 2.0 mm nozzle | 3.0 mm nozzle | 4.0 mm nozzle |
|---|---|---|---|---|
| 15 | 33.4 | — | — | - |
| 23 | — | — | — | — |
| 31 | 58.2 | 58.2 | — | 22.4 |
| 39 | 73.2 | — | — | — |
| 46 | — | 72.0 | 73.5 | 40.2 |
| 62 | — | 98.2 | 94.0 | 56.4 |
| 77 | — | — | 118.8 | 66.0 |
| 92 | — | — | 117.0 | 84.0 |

Efficiency Calculation

Figure 5:
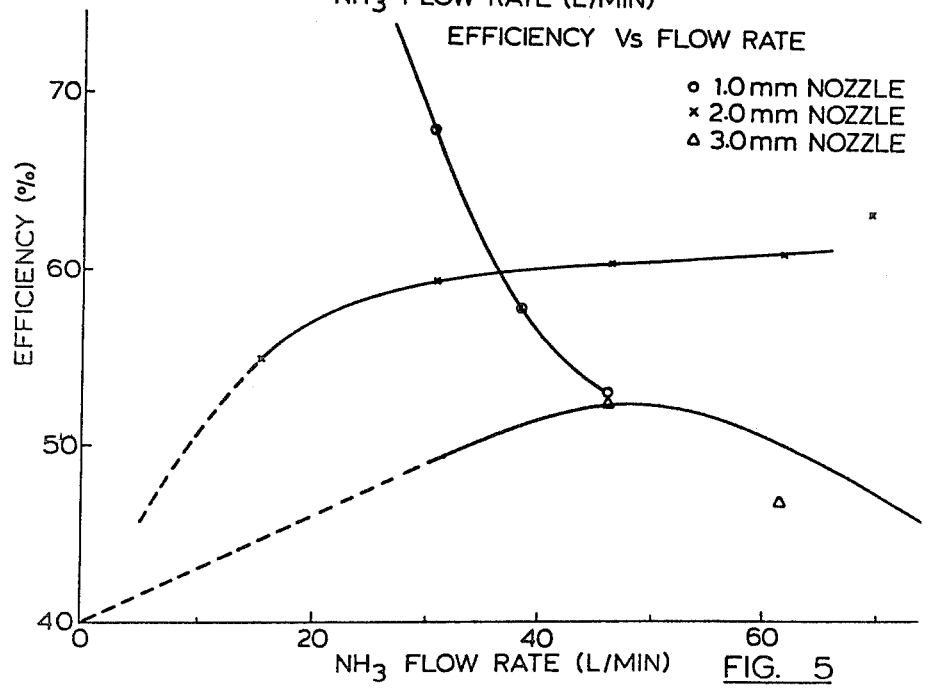
FIG. 5 is a graph showing the thermodynamic efficiency as a function of ammonia flow rate for various nozzles.

Thermodynamic analysis of the process has shown that the energy supplied in the reaction process is converted at an efficiency of 50–60% into ice destruction (FIG. 5).

For a 3.0 mm nozzle with an ammonia flow of 40 L/min $$\begin{aligned}
\text{Flow Rate of } NH_3 &= 40\ LL/\text{min} \\
&= .064 \text{ lb m/min at STP} \\
&= 29.1 \text{ gm/min at STP} \\
\text{Heat of Reaction} &= 29.1 \text{ gm/min} \times 490 \text{ cal/gm} \\
&= 14{,}259 \text{ cal/min} \\
\text{Rate of Ice Destruction} &= 105 \text{ cm}^3/\text{min} \\
\text{Heat of Fusion} &= 105 \frac{\text{cm}^3}{\text{min}} \times 0.9 \frac{\text{gm}}{\text{cm}^3} \times 80 \frac{\text{cal}}{\text{gm}} \\
&= 7560 \text{ cal/min} \\
\text{Efficiency} &= \frac{7{,}560}{14{,}259} = 53\%
\end{aligned}$$

Figure 4:
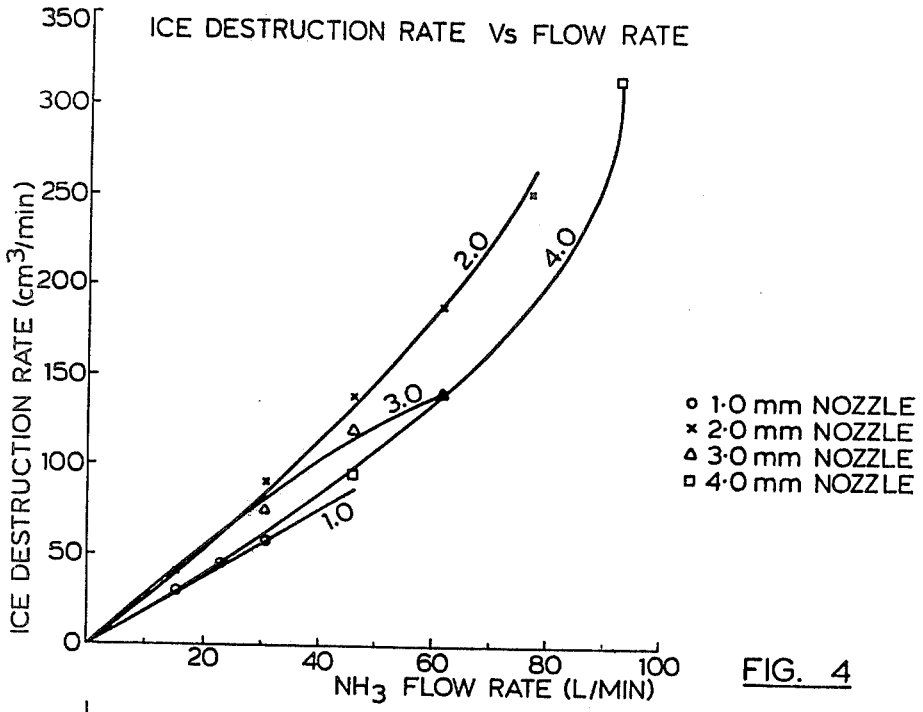
FIG. 4 is a graph showing ice destruction rate as a function of ammonia flow rate for various nozzles.

From the graphs previously described, the drilling rate for any specific flow rate can be obtained. Similarly a graph of volume of ice destroyed versus flow rate was obtained (FIG. 4).

This information combined with the efficiencies at different flow rates enables one to determine the optimum flow rate and nozzle size for the maximum utilization of an ammonia tank. Thermodynamic efficiency can be calculated by using the equation:

$$\text{Efficiency} = \frac{\text{energy consumed in phase change reaction}}{\text{energy supplied by reactant}}$$

From the calculated efficiencies a graph of efficiency versus flow rate was constructed (FIG. 5).

From these graphs it can be determined that in order to obtain a high drilling rate (approximately 140 cm/min), a 2.0 mm nozzle with an ammonia flow of approximately 80 L/min would be the most efficient. Similar tests can be carried out to determine the optimum operation conditions for the various other reactants proposed.

As previously indicated, when ammonia is used as a reactant it may be necessary to provide a secondary heating system to heat the ammonia tank to maintain the vapor pressure inside the ammonia tank. As the ammonia evaporates, it absorbs a considerable amount of heat from the liquid ammonia, thus reducing the temperature in the ammonia tank. If the ammonia removes too much heat, then the vapor pressure drops to an extent that the gas flow may not be sufficient for drilling at optimum rates.

In order to solve this problem, heat is applied in a sufficient quantity to maintain the vapor pressure in the ammonia tank at a working level. The power required to heat the tank in order to maintain this pressure with a flow of 80 L/min is 1300 watts. However, to provide for various flow rates under working conditions and where a 15 lb. ammonia tank is to be used, the heating system should have a minimum power density of 5600 watts/$m^2$ (2000 w/surface area of 15 lb. tank). If a 100 lb. tank is used (O.D.=12", L=49"), the area is 1.26 $m^2$. Thus, the power density required is reduced to approximately 1600 watts/$m^2$ (2000 w/1.26 $m^2$).

During preliminary tests, drilling was carried out without the aid of a rod plumbing device or guide of the type illustrated in FIG. 1 of the drawings. In the course of these tests, it was noted that difficulty was experienced in attempting to keep the drill rod perpendicular to the surface of the ice. The holes which were being drilled by manually supporting the drill rod were inclined at angles up to 30° from the vertical. It is believed that this problem was most likely due to flaws just below the surface of the ice. If there was a cavity, crack or soft spot in the ice, the rod would tend to penetrate this section first, thus causing the rod to move at an angle. This problem initiates near the surface of the ice with the walls of the hole formed by the drilling operation acting as a retainer to keep it at an angle. The guide mechanism illustrated in FIG. 1 of the drawings serves to overcome this problem.

From the foregoing it will be apparent that the present invention provides a simple and efficient system for drilling a hole in ice by chemical means. The reactant gas combines chemically and isothermally with the ice causing a phase change to the liquid state. Nozzles can be readily calibrated to determine the most efficient flow rate and the flow of reactant through the nozzle can be regulated to provide optimum drilling efficiency.

The system of the present invention provides a simple and efficient method and apparatus for drilling a hole in ice and for the destruction of a body of ice by chemical means.

What I claim as my invention is:

1. A method of destroying a body of ice comprising the steps of:

(a) providing a source of reactant gas of a type which will react isothermally with ice causing the formation of unstable compounds which immediately revert to water and dissolved gas, but will not react until it makes contact with ice or water, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum phase change reaction with the ice and advancing the nozzle towards the body of ice to continue to direct the stream of reactant gas against the receding surface of the body of ice as the ice changes phase.

2. A method of destroying a body of ice as claimed in claim 1 wherein the water formed from the ice is removed from the localized area as rapidly as possible after it has been formed so that it does not prevent direct impinging of the reactant gas onto the body of ice.

3. A method of destroying a body of ice as claimed in claim 2 wherein an inert gas is directed against the water to remove it from the localized area.

4. A method as claimed in claim 1, 2 or 3 wherein nitrogen is mixed with the reactant gas at or prior to discharge from the nozzle.

5. A method of destroying a body of ice as claimed in claim 2 or 3 wherein the reactant gas is selected from the group consisting of Ammonium salts of the Halogens, Halogen Acids, Ammonium Salts of Sulfur, Oxygen Acids and Oxides of Sulfur.

6. A method of destroying a body of ice as claimed in claims 2 or 3 wherein the reactant gas is selected from the group consisting of ammonia, hydrogen chloride, sulphur dioxide and ammonium chloride.

7. A method of drilling a hole in a body of ice comprising the steps of:

(a) providing a source of a reactant gas of a type which will react isothermally with ice causing the formation of unstable compounds which will revert to water and dissolved gas, but will not react until it makes contact with ice or water, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum phase change reaction with the ice and thus destroy the ice in the localized area, (e) advancing the nozzle towards the body of ice to continue to direct the stream of reactant gas against the receding ice in the localized area as the ice is destroyed to form a hole in the body of ice.

8. A method of drilling a hole in a body of ice as claimed in claim 7 wherein water formed from the ice is removed from the localized area as rapidly as possible after it has been formed so that it does not prevent direct impinging of the reactant gas onto the body of ice.

9. A method of drilling a hole in a body of ice as claimed in claim 8 wherein an inert gas is directed against the melt water to remove it from the localized area.

10. A method of drilling a hole in a body of ice as claimed in claim 8 or 9 wherein the reactant gas is selected from the group consisting of Ammonium salts of the Halogens, Halogen Acids, Ammonium Salts of Sulfur, Oxygen Acids and Oxides of Sulfur.

11. A method of drilling a hole in a body of ice as claimed in claim 8 or 9 wherein the reactant gas is selected from the group consisting of ammonia, hydrogen chloride, sulphur dioxide and ammonium chloride.

12. A method of destroying a body of ice comprising the steps of:

(a) providing a source of reactant gas selected from the group consisting of ammonia, hydrogen chloride, sulphur dioxide and ammonium chloride which react with ice to affect a rapid breakdown of the ice, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum reaction with the ice and thereby affect a rapid breakdown of the ice.

13. A method as claimed in claim 7, 8 or 12 wherein nitrogen is mixed with the reactant gas at or prior to discharge from the nozzle.

14. A method of destroying a body of ice comprising the steps of:

(a) providing a source of reactant gas selected from the group consisting of ammonium salts of halogens, halogen acids, ammonium salts of sulfur, oxygen acids and oxides of sulfur which will react isothermally with ice causing the formation of unstable compounds which immediately revert to water and dissolved gas, but will not react until it makes contact with ice or water, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum phase change reaction with the ice and advancing the nozzle towards the body of ice to continue to direct the stream of reactant gas against the receding surface of the body of ice as the ice changes phase.

15. A method of destroying a body of ice comprising the steps of:

(a) providing a source of reactant gas selected from the group consisting of ammonia, hydrogen chloride, sulphur dioxide and ammonium chloride which will react isothermally with ice causing the formation of unstable compounds which immediately revert to water and dissolved gas, but will not react until it makes contact with ice or water, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum phase change reaction with the ice and advancing the nozzle towards the body of ice to continue to direct the stream of reactant gas against the receding surface of the body of ice as the ice changes phase.

16. A method of drilling a hole in a body of ice comprising the steps of:

(a) providing a source of reactant gas selected from the group consisting of ammonium salts of halogen acids, ammonium salts of sulfur, oxygen acids and oxides of sulfur which will react isothermally with ice causing the formation of unstable compounds which will revert to water and dissolved gas, but will not react until it makes contact with ice or water, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum phase change reaction with the ice and thus destroy the ice in the localized area, (e) advancing the nozzle towards the body of ice to continue to direct the stream of reactant gas against the receding ice in the localized area as the ice is destroyed to form a hole in the body of ice.

17. A method of drilling a hole in a body of ice comprising the steps of:

(a) providing a source of reactant gas selected from the group consisting of ammonia, hydrogen chloride, sulfur dioxide and ammonium chloride which will react isothermally with ice causing the formation of unstable compounds which will revert to water and dissolved gas, but will not react until it makes contact with ice or water, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum phase change reaction with the ice and thus destroy the ice in the localized area, (e) advancing the nozzle towards the body of ice to continue to direct the stream of reactant gas against the receding ice in the localized area as the ice is destroyed to form a hole in the body of ice.

18. A method of destroying a body of ice comprising the steps of:

(a) providing a source of reactant gas selected from the group consisting of ammonium salts of the halogens, halogen acids, ammonium salts of sulfur, oxygen acids and oxides of sulfur which react with ice to affect a rapid breakdown of the ice, (b) directing said reactant gas through a nozzle to generate a stream of reactant gas, (c) locating said nozzle in close proximity to a body of ice, (d) directing said stream of gas against a localized area of the surface of said body of ice at a velocity and flow rate to obtain an optimum reaction with the ice and thereby affect a rapid breakdown of the ice.

19. A method of destroying a body of ice comprising the steps of:

(a) providing a source of reactant gas of a type which will react isothermally with ice causing the formation of unstable compounds which immediately revert to water and dissolved gas but will not react until it makes contact with ice or water.

(b) directing said reactant gas through a 2mm nozzle at a flow rate of 800 L/min to generate a stream of reactant gas, (c) locating said nozzle in close proximity to a body of ice, (d) directing said stream of gas against a localized area of the surface of said body of ice at a velocity to obtain an optimum phase change reaction with the ice and advancing the nozzle towards the receding surface of the localized area of the body of ice at a rate of 140 cm/min to continue to direct the stream of reactant gas against the receding surface of the body of ice as the ice changes phase.

20. A method of drilling a hole in a body of ice comprising the steps of:

(a) providing a source of reactant gas of a type which will react isothermally with ice causing the formation of unstable compounds which will revert to water and dissolved gas, but will not react until it makes contact with ice or water, (b) directing said reactant gas through a 2 mm nozzle at a flow rate of 80 L/Min to generate a stream of reactant gas, (c) locating said nozzle in close proximity to a body of ice, (d) directing said stream of gas against a localized area of the surface of said body of ice at a velocity to obtain an optimum phase change reaction with the ice and thus destroy the ice in the localized area, (e) advancing the nozzle towards the receding surface of the localized area of the body of ice at a rate of 140 cm/min to continue to direct the stream of reactant gas against the receding ice in the localized area as the ice is destroyed to form a hole in the body of ice.

21. An apparatus for drilling a hole in a body of ice comprising:

(a) a container containing a pressurized reactant gas selected from the group consisting of ammonium salts of the halogens, halogen acids, ammonium salts of sulfur, oxygen acids and oxides of sulfur which will react isothermally with ice causing the formation of unstable compounds which immediately revert to water and dissolved gas, but will not react until it makes contact with ice or water, (b) a hollow drilling rod having a nozzle at one end thereof, (c) conduit means connecting said hollow drilling rod with said reactant gas and, (d) valve means for regulating the flow of reactant gas from said container to said hollow drilling rod, said valve means being operable to control the flow rate and velocity of the stream of gas discharged from said nozzle to obtain an optimum chemical reaction with the ice as the nozzle is advanced into a body of ice to form a hole.

22. An apparatus as claimed in claim 21 including heater means disposed in a heat exchange relationship with said container for heating said reactant gas.

23. An apparatus for drilling a hole in a body of ice comprising:

(a) a pressurized container containing a source of reactant gas selected from the group consisting of ammonium, hydrogen chloride, sulfur dioxide and ammonium chloride which will react with ice to effect a rapid breakdown of the ice, (b) a hollow drilling rod having a nozzle at one end thereof, (c) conduit means connecting said hollow drilling rod with reactant gas; and (d) valve means for regulating the flow of reactant gas from said container to said hollow drilling rod, said valve means being operable to control the flow rate and velocity of the stream of gas discharged from said nozzle to obtain an optimum chemical reaction with the ice as the nozzle is advanced into a body of ice to form a hole.

24. An apparatus as claimed in claim 23 including heater means disclosed in a heat exchange relationship with said container for heating said reactant gas.

25. An apparatus for drilling a hole in a body of ice comprising:

(a) a pressurized container containing a source of reactant gas selected from the group consisting of ammonium, hydrogen chloride, sulfur dioxide and ammonium chloride which will react with ice to effect a rapid breakdown of the ice, (b) a hollow drilling rod having a nozzle at one end thereof, (c) conduit means connecting said hollow drilling rod with said reactant gas; and (d) valve means for regulating the flow of reactant gas from said container to said hollow drilling rod, said valve means being operable to control the flow rate and velocity of the stream of gas discharged from said nozzle to obtain an optimum chemical reaction with the ice as the nozzle is advanced into a body of ice to form a hole.

26. An apparatus for drilling a hole in a body of ice comprising:

(a) a first container containing pressurized ammonium, (b) a second container containing pressurized nitrogen;

(c) a hollow drilling rod having a nozzle at one end thereof and first and second passages leading to said nozzle, said first and second passages each having a discharge end at the nozzle arranged to mix the streams discharged therefrom;

(d) first conduit means connecting said pressurized ammonium of the first container to said first passage of said drilling rod and second conduit means connecting said pressurized nitrogen of said second container to said second passage of said drilling rod;

(e) first valve means for regulating the flow of gas from said first container through said first conduit; and (f) second valve means for regulating the flow of gas from said second container through said second conduit.

* * * * *